United States Patent [19]

Fredrickson et al.

[11] 3,934,422

[45] Jan. 27, 1976

[54] PILE SPLICING APPARATUS AND METHOD

[76] Inventors: Larry E. Fredrickson; Thomas L. Coates, both of 529 S. 49th St., Tacoma, Wash. 98404

[22] Filed: Nov. 11, 1974

[21] Appl. No.: 522,777

[52] U.S. Cl. ..... 61/53; 61/54; 52/169; 52/514

[51] Int. Cl.[2] ..... E02D 5/60

[58] Field of Search ..... 61/54, 53, 56, 34, 35; 52/169

[56] References Cited

UNITED STATES PATENTS

| | | | |
|---|---|---|---|
| 790,230 | 5/1905 | Stempel | 61/54 |
| 2,412,185 | 12/1946 | Weber | 61/54 |
| 3,345,824 | 10/1967 | Turzillo | 52/169 X |
| 3,352,118 | 11/1967 | Burkhardt | 61/54 X |
| 3,553,970 | 1/1971 | Wiswell | 61/54 |
| 3,719,049 | 3/1973 | Shaw et al. | 61/54 |
| 3,720,068 | 3/1973 | DeRosa | 61/54 |
| 3,726,950 | 4/1973 | Turzillo | 61/35 |

*Primary Examiner*—Dennis L. Taylor
*Attorney, Agent, or Firm*—Eugene D. Farley

[57] ABSTRACT

Top and bottom segments of marine piling are spliced and reinforced in situ by surrounding them with an elongated cage of concrete mesh rebar stock or like material, surrounding the cage with an elongated concrete form bag, spacing the cage from the piling and the form bag from the cage, and pouring the form bag full of concrete mix thereby integrating the piling segments, the cage and the form bag into a repaired or spliced pile of substantial strength. Where the splice extends below the mud line, the area about the pile first is excavated down into the underlying solid ground to provide a concrete form basin which also is filled with concrete to provide a footing for the spliced pile.

10 Claims, 6 Drawing Figures

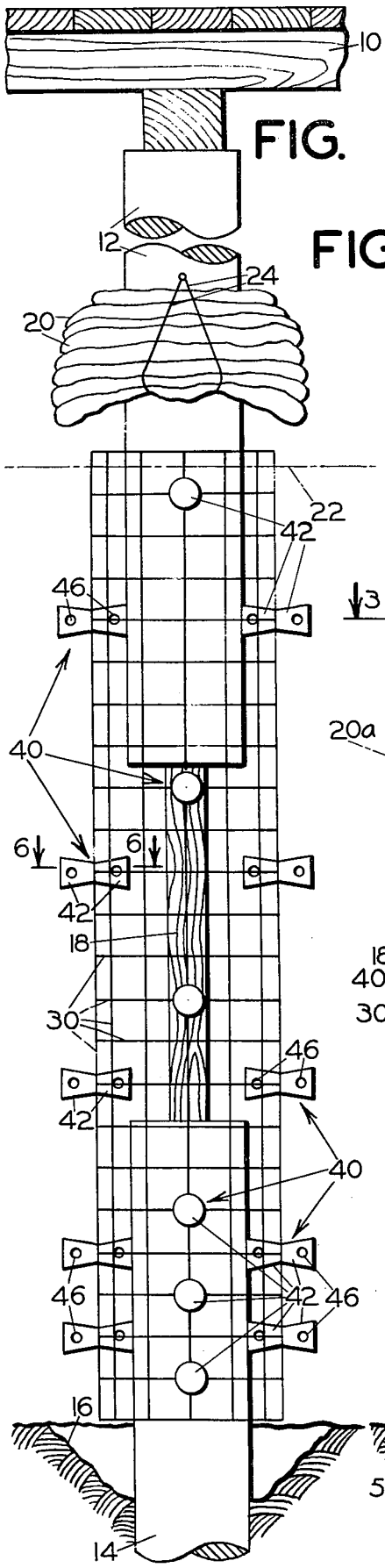
FIG. 1
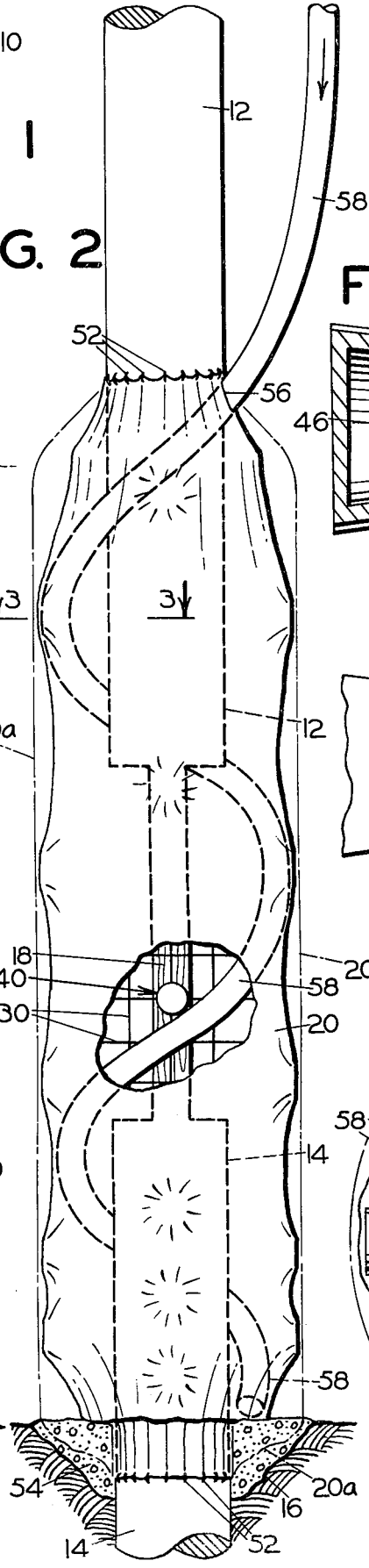
FIG. 2
FIG. 5
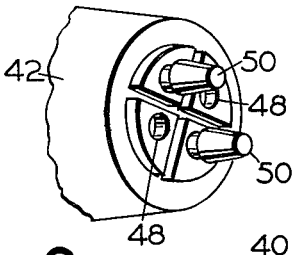
FIG. 6
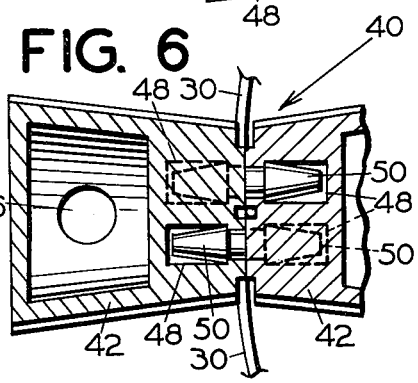
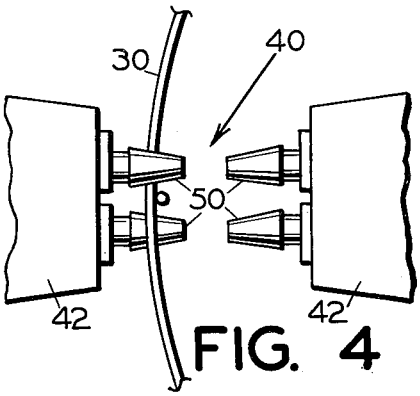
FIG. 4
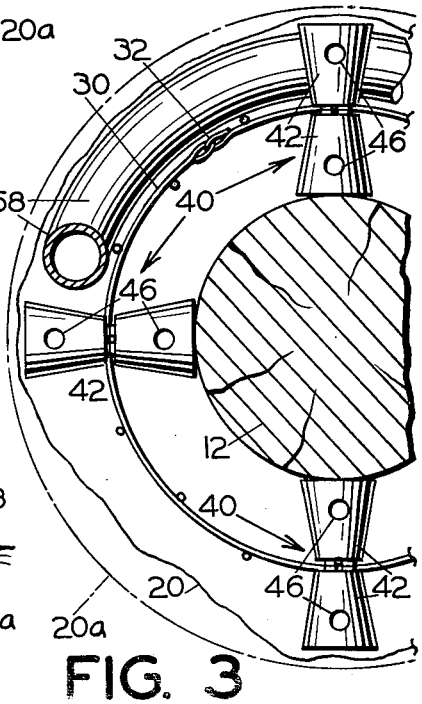
FIG. 3

PILE SPLICING APPARATUS AND METHOD

BACKGROUND OF THE INVENTION

This invention relates to apparatus and method for splicing piles. It pertains particularly to apparatus and method for restoring to useful condition rotten and deteriorated marine piling such as are used to support docks, bridges, spans, trestles and like structures.

It is applicable particularly to the splicing of wooden piling although it conceivably could be applied to the strengthening or reenforcing of steel or concrete columns as well.

The piling used in harbors are along waterways to support docks, piers, bridges, trestles and like installations has a limited useful life because of the deteriorating effect of the elements, decay microorganisms, and, in particular, marine borers. When the piling has deteriorated to the point where the supported structure is dangerously weakened, the repair of the structure is made difficult because of its marine location and because of the fact that the defective piling are in an inaccessible location, beneath the structure they support. Accordingly, it is necessary in many instances to tear the structure down, replace the piling, and then rebuild the structure on the new piling. Where docks, warehouses and railroads are supported on the piling, a substantial inconvenience and economic loss result.

In the past it has been proposed to overcome this problem by cutting the involved sections from a defective pile, inserting a length of sound pile, and supporting the resulting patched pile by means of sleeves or other bracing elements placed about the joints. This practice has been unsatisfactory since it has been impossible to match the cuts of the pile segments so that uniform bearing across the meeting surfaces is obtained. As a result, the composite pile will tend to telescope, or slip sideways because of the angularity of the bearing faces, with resultant disadvantage to the supported structure.

It also has been proposed to splice piling by the use of various appliances placed about the pile and used as forms to cast concrete in situ about the deteriorated section of the pile, thereby strengthening and reinforcing it. However, the appliances used for this purpose have been cumbersome, expensive, difficult to use, and not productive of a splice of adequate strength. Furthermore, it has not been possible using the apparatus and method of the prior art to produce a concrete pile splice of uniform strength and dimensions in all of its areas.

It accordingly is the general purpose of the present invention to provide apparatus and method for splicing marine piling to produce a spliced pile of great strength, uniform properties, and accurate dimensions.

A further object of this invention is to provide apparatus and method for splicing piling which may be applied to any designated areas of piling, at substantial depths, and irrespective of the condition of the piling as long as it includes usable top and bottom segments.

Still another object of the present invention is the provision of apparatus and method for splicing piling which may be applied safely and inexpensively to piling or other supporting structures of diverse dimension, shapes, and degrees of deterioration.

SUMMARY OF THE INVENTION

The foregoing and other objects of this invention are accomplished by the provision of a method for splicing in situ pile deteriorated by the action of the elements, microorganisms, or marine borers, which takes advantage of the fact that no matter how severely such piling has deteriorated above the mud line, there uniformly exists below the mud line a stud pile which usually extends into the mud a good many feet and which is perfectly sound. This stud accordingly is used as the base or foundation for building up a new pile including segments of the old pile by a method which includes the following steps:

Assuming that the deteriorated pile consists of a top segment underlying the dock or other structure, a sound bottom or stud segment buried in the mud, and an intermediate segment in various degrees of deterioration, the deteriorated segment may first be sawn away and a supporting post inserted in the resulting gap. An elongated concrete form bag of longitudinally collapsible, substantially fluid-concrete-impermeable material is fastened in collapsed condition to the upper segment.

An elongated cage of stiff, fluid-cement-permeable mesh material, such as mesh concrete form rebar, is wrapped around the piling, overlapping the top and bottom segments and bridging the gap between. A plurality of radially extending spacers are supported on the cage at predetermined intervals. If necessary, the cage may be spiked or otherwise secured to the top and bottom pile segments.

Next the bag is spread downwardly over the cage and fastened at its bottom end. Thereupon the spacers will bear on one end against the pile segments and on the other end against the inside surface of the form bag, spacing these members of the assembly from each other.

A concrete pouring hose then is introduced in the space between the cage and the form bag and wrapped spirally about the cage to the bottom of the assembly. Fluid concrete mix in unset condition is introduced into the form bag, the hose being withdrawn as the pour progresses. Because of the spiral application, a uniform distribution of the concrete is obtained.

Where the pile section to be treated extends to the vicinity of the mud line, the ground beneath the mud line preferably is jetted away to form a recess in a preliminary operation. This recess is filled with concrete to form a footing preliminary to filling the form bag.

The result is a finished spliced pile of uniform strength and contour from bottom to top and of great stability. This result is obtained without disturbing any of the superimposed structure and without the necessity of driving a new pile.

THE DRAWINGS

FIG. 1 is a foreshortened view in side elevation of a dock structure supported by a pile being spliced by the hereindescribed method with the apparatus employed for the purpose partly in position.

FIG. 2 is a fragmentary view in elevation similar to FIG. 1, the pile splicing operation being in a more advanced state.

FIG. 3 is a fragmentary sectional view taken along line 3—3 of FIG. 2.

FIGS. 4 and 6 are fragmentary, detail views in side elevation and longitudinal section, respectively, of a spacing element employed in the hereindescribed pile splicing apparatus, illustrated in its open and closed positions, respectively; and FIG. 5 is a fragmentary, detail perspective view further illustrating the spacing element of FIGS. 4 and 6.

DETAILED DESCRIPTION OF A PREFERRED EMBODIMENT

In the execution of the presently described pile splicing method, the defective pile section may either be retained, or in a preliminary operation it may be cut away, leaving an upper pile segment and a lower pile segment both of which are in relatively sound condition. In particular, the lower pile segment will be sound in the area below the mud line since microorganisms, crustaceons and other deteriorating agents are not active below the mud line, even over periods of many years. The embedded lower segment thus forms a stub upon which the repaired pile may be supported.

In another preliminary operation, the retained top and bottom segments are scraped to remove crustaceans and debris. In still a further preliminary operation, where the splice is to extend to the mud line, the area about the bottom of the pile is excavated by jetting or otherwise to provide a recess or hole 2 or 3 feet deep. As will be shown hereinafter, this serves as a form for casting a footing to be integrated with the spliced structure.

The result is the assembly in its preliminary phase illustrated in FIG. 1.

In this figure, the dock supported in part by the pile in question is indicated at 10. The upper segment of the pile, cut off and cleaned, is indicated at 12. The lower pile segment, also cleaned and extending downwardly into the mud, is illustrated at 14. The recess or hole to be used as a concrete footing form is shown at 16.

The top and bottom pile segments are separated by a gap, in the event that a deteriorated central section of the pile has been sawn away.

Where the top and bottom pile segments are separated by a space, they may be stabilized by the insertion of a support post 18 the ends of which are toe-nailed to the pile segments.

The three key components of the hereindescribed pile splicing apparatus are first, an elongated concrete form bag used to contain and form the concrete employed in splicing the pile; second, an elongated cage of stiff mesh material used to interconnect the top and bottom pile segments and provide a body for the apparatus preliminary to filling the form bag with concrete; and third, a plurality of radially extending spacers supported on the cage and serving the functions of spacing the cage from the pile segments and the concrete form bag from the cage.

Considering these in order:

The first of these, concrete form bag 20, comprises a length of longitudinally collapsible, substantially fluid-concrete-impermeable material dimensioned to extend the entire length of the pile section to be treated. This may be as much as 40 feet, or even more.

Since the form bag will contain several tons of concrete mix, it is essential that it be characterized not only by non-porosity, but also by great strength. Also, it should be resistant to the action of microorganism and sea animals over long periods of time, since it adds strength and stability to the piling even after the concrete has set.

Although various materials may be employed, a preferred material comprises non-porous, woven, Nylon fabric. This fabric is available in the form of woven cloth having a tensile strength of over 16 pounds per square inch on the warp and the same strength on the fill.

The concrete form bag may be supplied as a tube or hollow cylinder of the desired diameter. It may be either seamed or seamless. In certain situations, it may be more convenient to supply it as a flat sheet having a zipper along its longitudinal edges so that during construction of the apparatus, the form bag may be made by wrapping the sheet around the cage and closing the zipper.

In the form of the invention illustrated in FIGS. 1 and 2, the form bag 20 comprises a tube of the selected fabric. It is applied in the preliminary stage by being collapsed longitudinally and slipped upwardly over the lower end of upper pile segment 12, before support post 18 has been inserted between the pile segments. The collapsed form bag is elevated to approximately the upper limit of the splice, which may or may not be above the water line 22. It is maintained there temporarily by means of ties 24 tacked to the pile segment.

The second key component of the hereindescribed pile splicing assembly comprises a cage 30. This has a length sufficient to cover the entire splice area. It has a diameter greater than the pile segments to be spliced together, but less than that of form bag 20. Like the form bag, it normally is of cylindrical contour, though this is not necessarily so.

Cage 30 may be fabricated from various structural materials provided they are stiff, self-supporting and fluid-concrete-permeable. Wire mesh of substantial pore size is suitable, and number 9 concrete rebar mesh is a preferred material.

When the cage is made from wire mesh or concrete rebar, it may be fastened together through integral fasteners 32 comprising reversely bent and interlocked, horizontally disposed wire components of the mesh, FIG. 3.

The third principal component of the hereindescribed pile splicing assembly comprise the radially extending spacing elements indicated generally at 40. These have for their function maintaining the pile segments, cage and concrete form bag properly aligned and in properly spaced relation to each other. Basically, the spacing elements comprise a first abutment section which bears against the pile segments, a second abutment section which bears against the form bag, and interlocking or fastening means which fasten the abutment sections to each other and to the cage. A preferred form of fastener and its manner of use are illustrated in FIGS. 3–6 inclusive.

Thus each spacer 40 comprises a first abutment section 42 which bears against the pile segment and a second abutment section which bears against the form bag. These sections are dimensioned to provide the necessary bearing surface, and also to space apart the assembly components to the desired and predetermined extent. In a typical instance spacing elements 42, may have lengths of 4 inches, thereby spacing the bag from the cage, and the cage from the piling, by like amounts.

Although each spacing element may be made of solid material, it is preferred to fabricate its outer areas from hollow sheet material for reasons of economy. A port 46 then may be provided in the hollow area to permit entry of fluid concrete mix.

Spacing elements 42, are interconnected by prong and socket type fasteners the construction and manner and application of which are shown particularly in FIGS. 4, 5 and 6.

Thus each spacing element 42 has a pair of spaced recesses 48 and also a pair of outwardly extending prongs or spurs 50 the heads of which are provided with retaining shoulders which match corresponding shoulders in the recesses. Recesses 48 and prongs 50 are arranged in a pattern such that when two of the spacing elements are arranged opposite each other, the prongs of one will register with the recesses of the other.

Prongs 50 are made of a deformable resilient material and accordingly when the two spacing elements are in their FIG. 4 position, one on each side of cage 30, they may be pressed together to assume the interlocked position of FIG. 6 with the wire mesh locked between the two elements. This supports the spacer in its radially extending position, ready for use.

OPERATION

The manner of splicing piling using the hereindescribed apparatus is as follows:

First the defective piling supporting a dock 10 is scraped clean of all marine growth and accumulations. Next, if necessary the defective central section is cut away to leave top pile segment 12 and bottom pile segment 14. A recess 16 is hollowed out about the base of the piling, below the mud line, by jetting or otherwise. In a typical case, where there is an overlying mud layer two feet thick, the recess may be excavated to a total depth of about three feet to extend it into solid ground.

Tubular concrete form bag 20 is collapsed and inserted over top segment 12 to a location marking the top of the splice. It is maintained temporarily in its collapsed position by means of ties 24.

Support post 18 is inserted between top and bottom pile segments 12, 14 and toe nailed to the latter for supporting and stabilizing the top segment. Spacers 40 are placed at predetermined intervals across the area of cage 30.

The wire cage with the spacers in place is wrapped around the pile by a diver so that it encircles part of the top and bottom pile segments and bridges the space therebetween. The meeting ends of the cage are interlocked by integral fasteners 32, as shown in FIG. 3.

The cage is maintained in position either frictionally or, preferably, by nailing it top and bottom to the pile segments.

Next the collapsed form bag is released and guided by the diver over the cage and attached spacers until it covers the entire cage and area to be spliced. Its bottom margin normally will extend into recess 16. It is pulled tight and nailed top and bottom with nails 52 to the top and bottom pile segments.

In an alternate procedure, where a zipper-equipped flat sheath is employed, the foregoing procedure is modified by placing the cage with attached spacers and then wrapping the sheath around the cage. The zipper is closed to form a tube which then is tacked top and bottom as before.

The assembly then has the appearance illustrated in FIG. 2. Cage 30 is spaced from pile segments 12, 14 by the inner abutment elements 42 of the spacers. It is spaced the desired distance from form bag 20 by the outer abutment elements 42 of the spacers.

The assembly thus is ready to receive and be filled by the poured cement mix. To this end there is provided a fast curing cement which first is poured in recess 16 to provide a footing 54. Next, an opening 56 is cut in the top of form bag 20.

With the help of a diver, a trimming hose 58 is worked through the opening and spiraled around the cage inside the bag in the manner shown in FIG. 2. The pour then is started. During the pour, the hose is withdrawn in spiral fashion as the pour progresses. This insures that the concrete will be distributed uniformly about the piling segments.

As the pour bag is filled with concrete, the fluid, unset cement mixture fills the areas about the piling segments, between the separated ends of the piling segments, between the meshes of cage 30, and between the cage and the inner surface of the form bag. This extends the latter until it assumes the configuration 20 of FIG. 2. It is to be noted that in this configuration it extends downwardly into the still soft cement of footing 54, thereby integrating the footing with the cement.

After pouring, the cement sets rapidly. In a typical instance, it developes a strength of 3,000 pounds break in 7 days, 4,000 pounds in 10 days and more than 5,000 pounds in 14 days.

The piling thus is restored to strength uniformly along its length. At the same time, cage 30 is protected by a substantial layer of concrete so that it does not space nor rust away. The surface of the concrete is protected from cracking by form bag 20a, which is left in position for the life of the piling.

This result is accomplished rapidly and with safety by a crew of but three men, who can splice as many as 15 piling a day. It is done without disturbing the pile-supported dock, warehouse, bridge or other installation, which can function in normal manner during the consummation of the splicing program.

Furthermore, the procedure is ecologically acceptable since it does not produce an environmental change in the water, and pilings, which are in short supply, are saved since new ones need not be used.

Having thus described our invention in preferred embodiments, we claim:

1. Apparatus for splicing in situ top and bottom segments of marine piling, the bottom segment being embedded in the ground, the apparatus comprising in combination:

a. an elongated cage of stiff, fluid-cement-permeable mesh material dimensioned to surround and overlap both of the pile segments while bridging the space between the segments, b. an elongated concrete form bag of longitudinally collapsible, substantially fluid-cement-impermeable material dimensioned to overlie the cage, c. a plurality of radially extending spacers dimensioned to abut the pile segments on one side of the cage and the concrete form bag on the other side of the cage, thereby spacing the cage predetermined radial distances to opposite sides of the pile segments and form bag, respectively, d. securing means securing the spacers to the cage, and e. fastening means fastening the top and bottom of the concrete form bag to the top and bottom segments of the marine piling, respectively.

2. The pile splicing apparatus of claim 1 wherein the pile segments are spaced from each other and including a post inserted in the space between the segments and bearing endwise against the same.

3. The pile splicing apparatus of claim 1 wherein each spacer comprises two separate abutment sections and the securing means comprises at least two prongs and cooperating recesses on the confronting surfaces of the abutment sections, the prongs being spaced apart laterally for receiving the cage mesh material between them.

4. The method of splicing in situ top and bottom segments of deteriorated piling which comprises:

a. mounting an elongated cage of stiff, fluid-cement-permeable mesh material about the piling, overlapping both of the pile segments, b. mounting an elongated concrete form bag of longitudinally collapsible, substantially fluid-cement-impermeable material about the cage, c. spacing the cage a predetermined radial distance outward from the piling and the concrete form bag a predetermined radial distance outward from the cage.

d. securing the top and bottom of the concrete form bag to the top and bottom segments of the piling, respectively, e. filling the spaces between the cage and piling and concrete form bag and cage with unset, pourable cement mix and f. permitting the cement mix to harden, thereby forming an integrated spliced pile including the piling segments, the cage, and the concrete form bag.

5. The method of claim 4 including the step of cutting away a deteriorated central section of the piling and inserting a support post between the residual top and bottom segments thereof preliminary to placing the cage and concrete form bag.

6. The method of claim 4 including the step of longitudinally collapsing the concrete form bag and attaching its upper end to the top pile segment preliminary to placement of the cage about the piling, and thereafter spreading the form bag downwardly about the cage and fastening its lower end to the bottom pile segment.

7. The method of claim 4 including the step of digging a hole of predetermined depth and span about the bottom of the piling below the mud line, extending the concrete form bag into the hole and securing it to the piling, filling the hole with unset liquid cement mix, and thereafter filling the concrete form bag with unset liquid cement mix before the liquid concrete mix in the hole has set, thereby forming a concrete footing integrated with the pile.

8. The method of claim 4 including the step of introducing unset fluid cement mix spirally about the pile in the space between the cage and the form bag.

9. The method of claim 4 including the initial steps of cutting away a deteriorated central section of the piling, longitudinally collapsing the concrete form bag and inserting it upwardly over the top piling segment, and inserting a support post between the top and bottom piling segments.

10. Apparatus for splicing in situ top and bottom vertically aligned segments of marine piling and comprising in combination:

a. a wire mesh cage dimensioned to surround and overlap both of the pile segments a spaced distance radially therefrom, b. a substantially water-impervious-concrete form bag dimensioned to overlie the cage and c. a plurality of radially extending spacers supported on the cage and dimensioned to space the cage a predetermined distance outward from the pile segments and the form bag a predetermined distance outward from the cage, d. each spacer comprising 1. two abutment sections one disposed on each side of the cage and 2. prong and recess interconnecting means on the adjacent faces of the abutment sections arranged for mutual interengagement of the sections with each other and with the wire mesh of the cage.

* * * * *